US005919022A

United States Patent [19]

La Coste

[11] Patent Number: 5,919,022

[45] Date of Patent: Jul. 6, 1999

[54] ELECTROMAGNETIC POSITIONING SYSTEM FOR CONTAINERS

[76] Inventor: Lee La Coste, 4013 Kent, Metairie, La. 70006

[21] Appl. No.: 08/796,360

[22] Filed: Feb. 6, 1997

Related U.S. Application Data

[60] Provisional application No. 60/011,208, Feb. 6, 1996.

[51] Int. Cl.[6] ..... B66C 1/66

[52] U.S. Cl. ..... 414/137.1; 414/803; 294/81.41; 294/907; 335/285; 269/8; 212/326

[58] Field of Search ..... 294/81.1, 81.41, 294/81.4, 81.53, 907; 414/391, 392, 396, 143.2, 137.1, 141.7, 142.8, 803, 603; 269/8; 209/904; 212/326; 335/285

[56] References Cited

U.S. PATENT DOCUMENTS

| | | | |
|---|---|---|---|
| 3,386,156 | 6/1968 | Griesemer et al. | 269/8 |
| 3,453,017 | 7/1969 | Nagy | 294/81.41 |
| 3,601,440 | 8/1971 | Evans | 294/81 |
| 3,807,582 | 4/1974 | Anderson | 414/141.3 |
| 4,018,349 | 4/1977 | Hupkes | 414/561 |
| 4,172,685 | 10/1979 | Nabeshima et al. | 294/81.41 |
| 4,179,149 | 12/1979 | Brochard | 294/81.41 |
| 4,396,218 | 8/1983 | Stevens | 294/81.41 |
| 4,414,522 | 11/1983 | Rybak | 294/65.5 |
| 5,560,663 | 10/1996 | Hara et al. | 294/81.41 |

FOREIGN PATENT DOCUMENTS

| | | | |
|---|---|---|---|
| 2383113 | 10/1978 | France | 294/81.41 |
| 2653467 | 6/1978 | Germany | 294/81.41 |
| 298899 | 3/1992 | Germany | 294/81.41 |
| 5338986 | 12/1993 | Japan | 294/81.41 |

*Primary Examiner*—David A. Bucci
*Assistant Examiner*—Douglas Hess
*Attorney, Agent, or Firm*—Joseph T. Regard, Ltd.

[57] ABSTRACT

An intermodal container positioning system for facilitating loading or positioning of intermodal containers via overhead crane or the like. The preferred embodiment of the present invention contemplates a system for positioning, in a precision matter, an intermodal container or the like upon the deck, or in the hold, of a ship or the like, or another transportation vehicle or storage area, wherein there is provided an array of electromagnets in various, alternative positions in the vicinity of the container, such that the electromagnets may be selectively utilized to engage adjacent structure, or other containers, in the vicinity of the container lock down or storage area, in such a manner as to manipulate the position of the container, to align same with other containers, a container holding area, lock down area, or the like. The invention may include a sensor array to monitor the position of the container relative to other containers or structures, or relative to lock down hardware, so as to vary the force on selective magnets in the array to manipulate the container, positioning same in the appropriate alignment for securing and/or parking. This sensor array may further compensate for wind, cable sway, or other factors which contribute to the lack of control of a container from a crane. The present invention may be mounted upon the spreader bar in a permanent or temporary fashion, or may be temporarily or permanently mounted at the lock-down or parking site, and may respectively thereby utilize the electromagnets to manipulate adjacent structure or containers via the spreader bar, or may be utilized to draw the container itself via exterior electromagnets attracting the Ferris metal comprising the container, in the case of an array mounted at the lock-down or parking site.

13 Claims, 7 Drawing Sheets

ELECTROMAGNETIC POSITIONING SYSTEM FOR CONTAINERS

REFERENCE TO A RELATED APPLICATION

This application is a continuation-in-part of U.S. provisional application Ser. No. 60/011,208, filed Feb. 06, 1996, entitled "Cargo Transport Electromagnet Positioning System for Containers", listing as the inventor Lee A. La Coste.

TECHNICAL FIELD of the INVENTION

The present invention relates to container loading systems, and in particular to an intermodal container positioning system for facilitating loading or positioning of intermodal containers via overhead crane or the like.

The preferred embodiment of the present invention contemplates a system for positioning, in a precision matter. an intermodal container or the like upon the deck, or in the hold, of a ship or the like, or another transportation vehicle or storage area, wherein there is provided an array of electromagnets in various, alternative positions in the vicinity of the container, such that the electromagnets may be selectively utilized to engage adjacent structure, or other containers, in the vicinity of the container lock down or storage area, in such a manner as to manipulate the position of the container, to align same with other containers, a container holding area, lock down area, or the like.

The invention may include a sensor array to monitor the position of the container relative to other containers or structures, or relative to lock down hardware, so as to vary the force on selective magnets in the array to manipulate the container, positioning same in the appropriate alignment for securing and/or parking. This sensor array may further compensate for wind, cable sway, or other factors which contribute to the lack of control of a container from a crane.

The present invention may be mounted upon the spreader bar in a permanent or temporary fashion, or may be temporarily or permanently mounted at the lock-down or parking site, and may respectively thereby utilize the electromagnets to manipulate adjacent structure or containers via the spreader bar, or may be utilized to draw the container itself via exterior electromagnets attracting the Ferris metal comprising the container, in the case of an array mounted at the lock-down or parking site.

BACKGROUND OF THE INVENTION

While the prior art includes plethora of patents relating to intermodal loading systems, none are believed to teach, contemplate, or otherwise suggest the present invention as disclosed herein.

Typically, 40 foot intermodal containers, and 20 foot half-sized intermodal containers are loaded into the hold of ships via an overhead crane. Generally, the container is suspended by a relatively long length of cable, making it difficult to position a loaded or unloaded container with precision.

Because it is generally necessary to place a container upon a particular mount or lock-down area, and because it is dangerous and expensive to require a group of workers to manually position a container above the lock-down area, a crane operator is left to having to swing the container into place from a distance, which often causes the container to bang into the ship hold structure, other, already loaded containers, and the like, damaging the loaded container and surrounding containers and structures.

Some examples of patents relating to the loading and/or securing of intermodal containers include:

| Patent Number | Inventor | Date of Issue |
|---|---|---|
| 5225728 | Oshima | 07/06/1993 |
| 4018349 | Hupkes | 04/19/1977 |
| 3812987 | Watatani | 05/28/1974 |
| 3807582 | Anderson | 04/30/1974 |
| 3700128 | Noble etal | 10/24/1972 |

As may be discerned by a review of the attached, cited patents, there exists various and diverse systems for automated loading, unloading, and stowage of containers or the like.

For example, see U.S. Pat. Nos. 4,018,349, 3,807,582, and 3,812,987 for various container loading/unloading systems for providing automated, controlled positioning of the containers to or from the vessel.

U.S. Pat. No. 5,225,728 entitled "Non-contact-Guidable Magnetic Floating Device" a device in a completely different class, is an example of the utilization of an oscillating magnetic field positioning system, and is cited for general information.

U.S. Pat. No. 3,700,128 issued 1972 to General Electric teaches an "Intermodal Transfer System" wherein there is taught an automated system for loading, aligning, and joining an intermodal container to a transfer car via a hoist, utilizing a positioning system for guiding a container upon the transfer car in a precision manner.

U.S. Pat. No. 4,096,816 teaches an example of a container lash system, and is provided for general information.

Based upon a review of the above, it appears that the prior art in this area does not suggest or contemplate a system for adjusting the position of a loaded container without the necessity for manual manipulation by workers, a dangerous and comparatively costly proposition.

SUMMARY DISCUSSION OF THE INVENTION

Unlike the prior art, the present invention provides a relatively easily implemented, cost effective, reliable and safe system for facilitating the precision positioning of full or half-sized intermodal-type containers at their loading, docking, or storage position.

The system of the present invention is primarily designed to electromagnetically position a cargo container or cargo containers prior to, and/or during the cargo containers' being loaded onto a ship or into the ship's hold or holds. It may also be satisfactorily be utilized to position a container upon a rail car, intermodal truck transport, loading dock, warehouse, or other situation where precision alignment is required.

The preferred embodiment of the present invention comprises a spreader bar which is configured to engage and allow the lifting of the container, the spreader bar having first and second ends and first and second side bars, forming first, second, third and forth corners, the spreader bar having mounted thereon a plurality of electromagnets which may be selectively engaged in such a manner as to facilitate attracting neighboring structure or containers, such that a container being lifted by the spreader bar may be positioned by energizing selective magnets in the spreader bar, attracting the energized magnet(s) to adjoining structure, facilitating movement of the energized magnet towards the structure, thereby manipulating the position of the spreader bar and supported container.

An alternative embodiment of the invention envisions the incorporation of electromagnets which are positioned either inside and/or above the ship's hold(s), or at any point, position or positions which will allow the electromagnets' magnetic fields to influence the velocity, position and/or direction of movement of the cargo container(s) as required by the design of the ship being loaded, the design, shape and size of its cargo hold(s), the size, shape and design of the cargo container(s) being loaded and the crane or other conveyance system used to load the cargo containers onto the ship or into the ships hold.

Once temporarily or permanently positioned and mounted, the electromagnets may be controlled through an electrical and/or electronic system which allows operator-selected manual or automatic control of the electromagnets both individually and/or collectively as required to influence the horizontal movement and/or lateral position of the cargo container(s) being loaded.

In operation, and electric current shall be supplied to any or all of the electromagnets in such a way as required at any given moment to cause the cargo container(s) to move in any direction or plane required to properly position it (them) on the ship and/or above or within the ship's cargo hold(s).

Automatic control may be accomplished by placing an integral or separate cargo container position system at any point in or on the ship, container or container, conveyance system which will allow the container, position sensing system to determine the container's position, motion and velocity with respect to the target. The container position sensing system will apply power to the electromagnets in a way which will draw the cargo container through a plane or planes resulting in its being properly positioned and/or held in the proper position to be loaded. Technology which may be used by the container position sensing system may be ultrasonic, laser, LED, radar or any other technology available which can provide container(s) range, velocity and/or direction of movement information.

Manual control of the electromagnets may be accomplished through manipulation by the system's operator of a multi-position lever or "joystick" electrically connected to the electromagnets control system.

Both automatic and manual control shall be fully operator-adjustable with respect to gain, reset electromagnet gauss-strength actuator distance and fail-safe parameters.

It is therefore an object of the present invention to provide a cargo container manipulation system for a container supported by a cable utilizing magnetic means to facilitate positioning of the container at the lock-down, or parking site.

It is another object of the present invention to provide a cargo container positioning system which is particularly suitable for use in conjunction with intermodal-type containers.

It is another object of the present invention to provide a cargo container positioning system which is relatively easy to implement, safe to operate, and which speeds loading of containers without additional manual labor or supervision.

Lastly, it is an object of the present invention to provide a cargo container positioning system which may be utilized to load both twenty and forty foot containers without the substantively changing the system.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
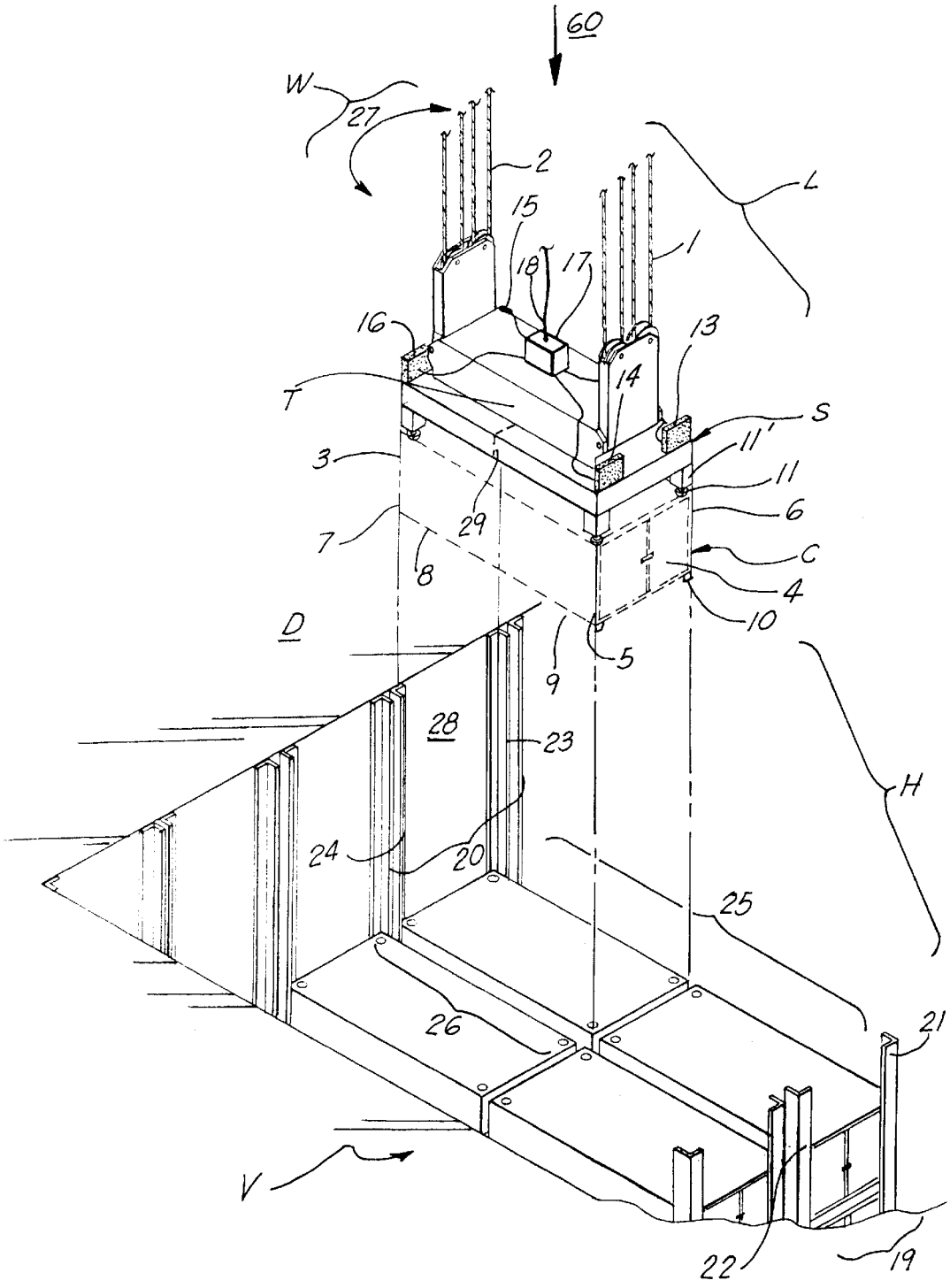
FIG. 1 is an isometric view of the preferred embodiment of the system of the present invention, illustrating the placement of an array of electromagnets along the perimeter edges of a spreader bar suspended by a trolley, and the illustrative loading of a cargo container into the hold of a ship.

Referring to FIG. 1 of the drawings, illustrated is a vessel V having a hold H open from the upper level deck D of the vessel V, the hold having shown therein a plurality of twenty foot container vessels in typical loaded arrangement.

Suspended by first 1 and second 2 cables is a trolley mechanism T, typically controlled by an overhead crane, the trolley T having situated thereunder a spreader bar S, which may be telescoping 29 to accommodate both 20 foot containers (shown), as well as the standard 40 foot intermodal type containers.

As shown, the spreader bar typically includes four connectors 11' for engaging, via standard intermodal connection 11, the four corners of the upper side of a container, so as to suspend same during loading operations. The container C shown is a twenty (20) foot length, having first 3 and second 4 ends, first 5, second 6, third 7, and fourth 8 edges, and a bottom side 9 having internodal connection capacity 10 along its four corners on the bottom side.

The spreader bar has a length L and width W generally corresponding to the length and width of the container, and is shown as having a generally rectangular configuration, forming four corners, a bottom side which engages the container C, and a top side which engages the trolley T.

Situated along the four opposing corners of the spreader bar is first 13, second 14, third 15, and fourth 16 electromagnets forming an electromagnet array, each of the electromagnets individually controlled and powered by a power supply, which may be variable, which power supply 17 may be controlled from a remote location via control/power wires 18.

The hold H of the vessel V illustrates a somewhat typical design for container vessels, wherein there are provided a plurality of slot channels 25, comprising second 21, third 22, first 23, and second 24 slots, which may be formed from angle irons, as shown in the drawings; as shown, the second and third slots, forming the second set 19 are designed to a degree engage a first end of a forty (40) foot container, with the first and second slots, forming the second set 20 are set to engage the second end of the container, allowing the container to be positioned at the upper portion of the hold into the appropriate slot, and slid down to the lower deck or container upon which it is stacked, providing a neatly set, reinforced stack of containers.

As intermodal transportation increases flexibility, there has emerged the half container, or twenty foot container, as a shipping alternative. The twenty foot container may be shipped in the same hold as forty foot containers, but there arises some difficulty in positioning the twenty foot containers in the forty foot slot, as only one end of the container engages one set of slots, the other end being free, with the twenty foot containers only being about ½ the length 26 of the forty foot containers length 25.

This is shown in FIG. 1, where the first end of the twenty foot container 3 is positioned within the general vicinity of the first set 20 of slots, but cannot be held in place while the container is lowered 60 into the hold.

To compound difficulties in positioning the container, the trolley T is generally suspended by an overhead crane, which may be situated far above the vessel, suspending the trolley by a long cable, which sways or oscillates due to momentum, wind, movement, etc. As generally no manual help is available to stop the unwanted movement, the crane operator is often left with having to collide the container with the support wall 28, other containers, in the vicinity, or other structure, potentially damaging the hoisted container, as well as the other containers and structure which it may encounter.

Figure 2:
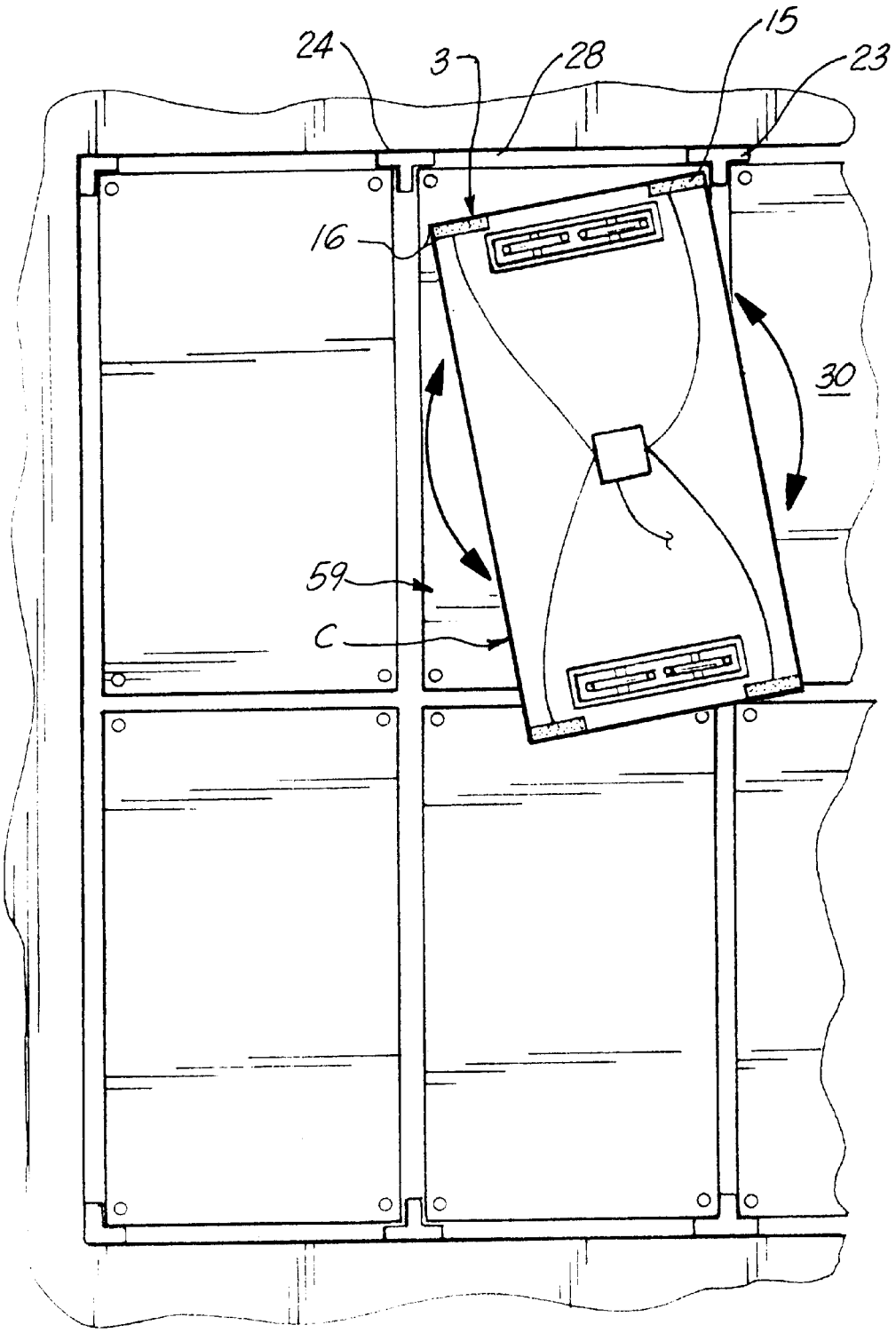
FIG. 2 is a top view of the system of FIG. 1 illustrating the lowering of the cargo container into the ship hold, and typical oscillation of the cargo associated therewith.

FIG. 2 illustrates a typical positioning of a container in the hold, with the trolley and container oscillating 30 thereby making it difficult to position the container at the appropriate attitude for properly parking the container in the lock-down area 59.

Referring to FIGS. 1 and 2, in practicing the system of the present invention, the crane operator positions the container C such that its first end 3 is positioned generally between first 23 and second 24 slots, and generally adjacent to the support wall 28 (when there is provided a support wall), with the second 15 and third 16 electromagnets likewise positioned.

Figure 3:
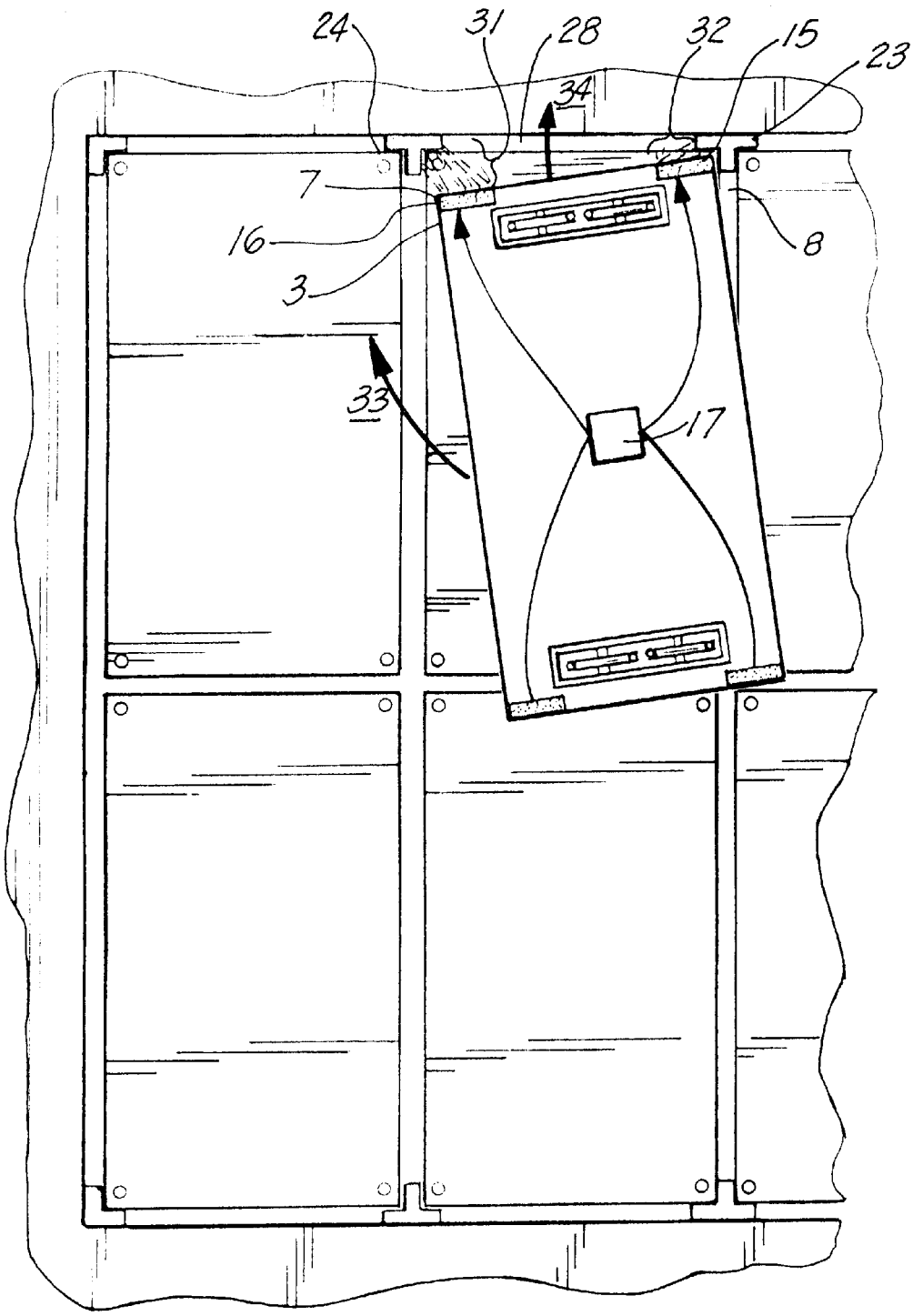
FIG. 3 is a top view of the system of FIG. 1 illustrating the energizing of selected electromagnets on the spreader bar, with generated magnetic fields shown as dashed lines.
Figure 4:
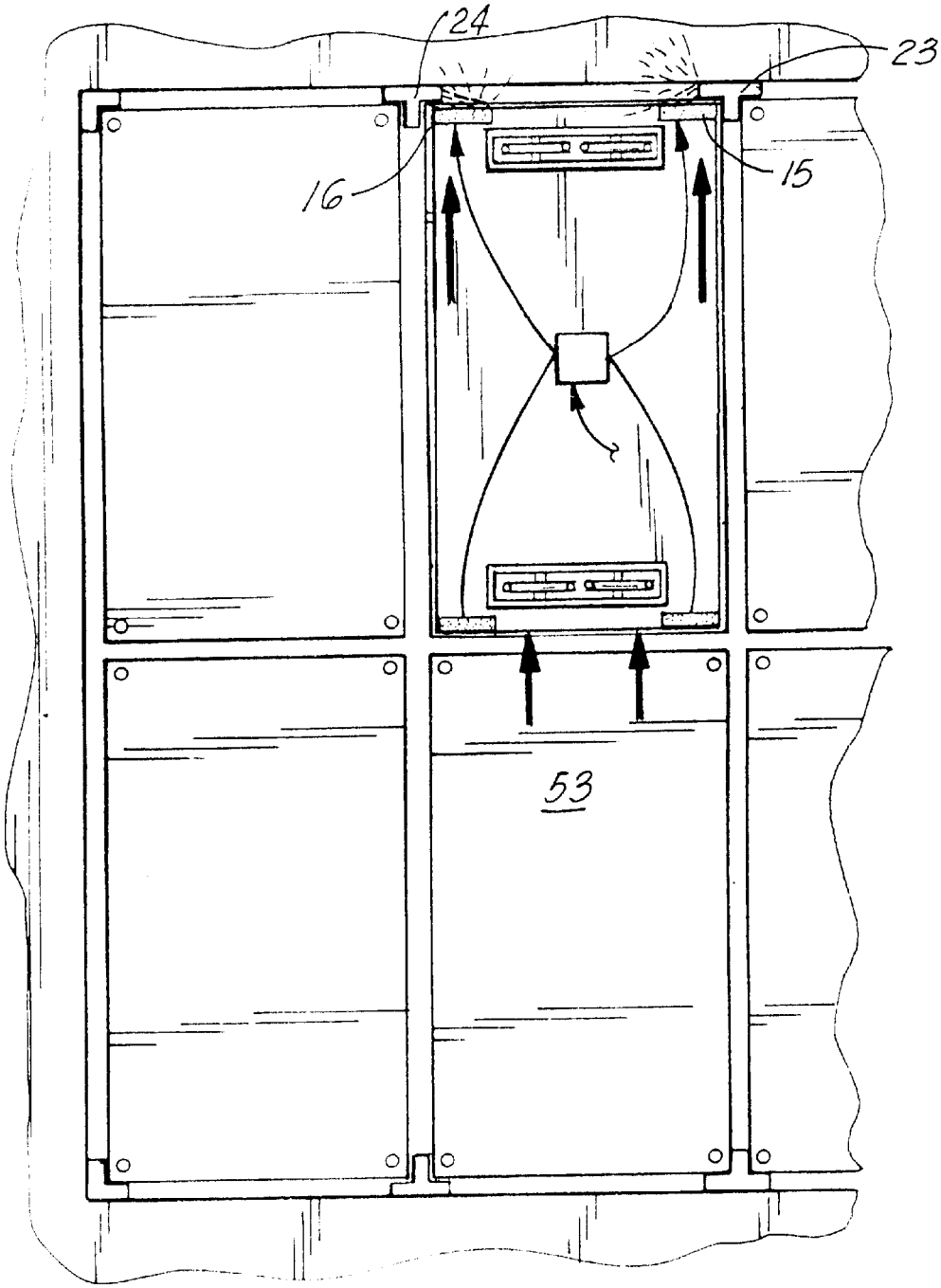
FIG. 4 is a top view of the preferred embodiment of the system of FIG. 1, illustrating the engagement of the energized electromagnets of FIG. 3 to the support wall, and resulting positioning of the cargo supported by the spreader bar, wherein the first end edges of the container are positioned between the loading slot.

Next, referring to FIG. 3, the power supply 17 is initiated to energize the second 15 and third 16 magnets, forming first 31 and second 32 electromagnetic fields, which attracts the magnets to the Ferris metals forming the support wall 28 and/or respective slots 23, 24, urging 33, 34 the magnets, and hence the spreader bar and container, between the second and third slots, finally drawn 53 between the slots 23, 24 by magnets 15, 16, respectively, as shown in FIG. 4, thereby aligning the container, spreader bar, and trolley, into the proper orientation between the slots for lowering the container for lock down.

It is noted that the operator may choose to cease lowering the trolley while engaging the magnets, until alignment has occurred, then resume lowering the container to the lock-down area, and re-energize the selected magnets as necessary to correct attitude.

Once the container is lowered to the lock down area, the connectors on the bottom side of the container are engaged, and the connectors on the upper portion of the container are disengaged, freeing the spreader bar to load another container.

Figure 3A:
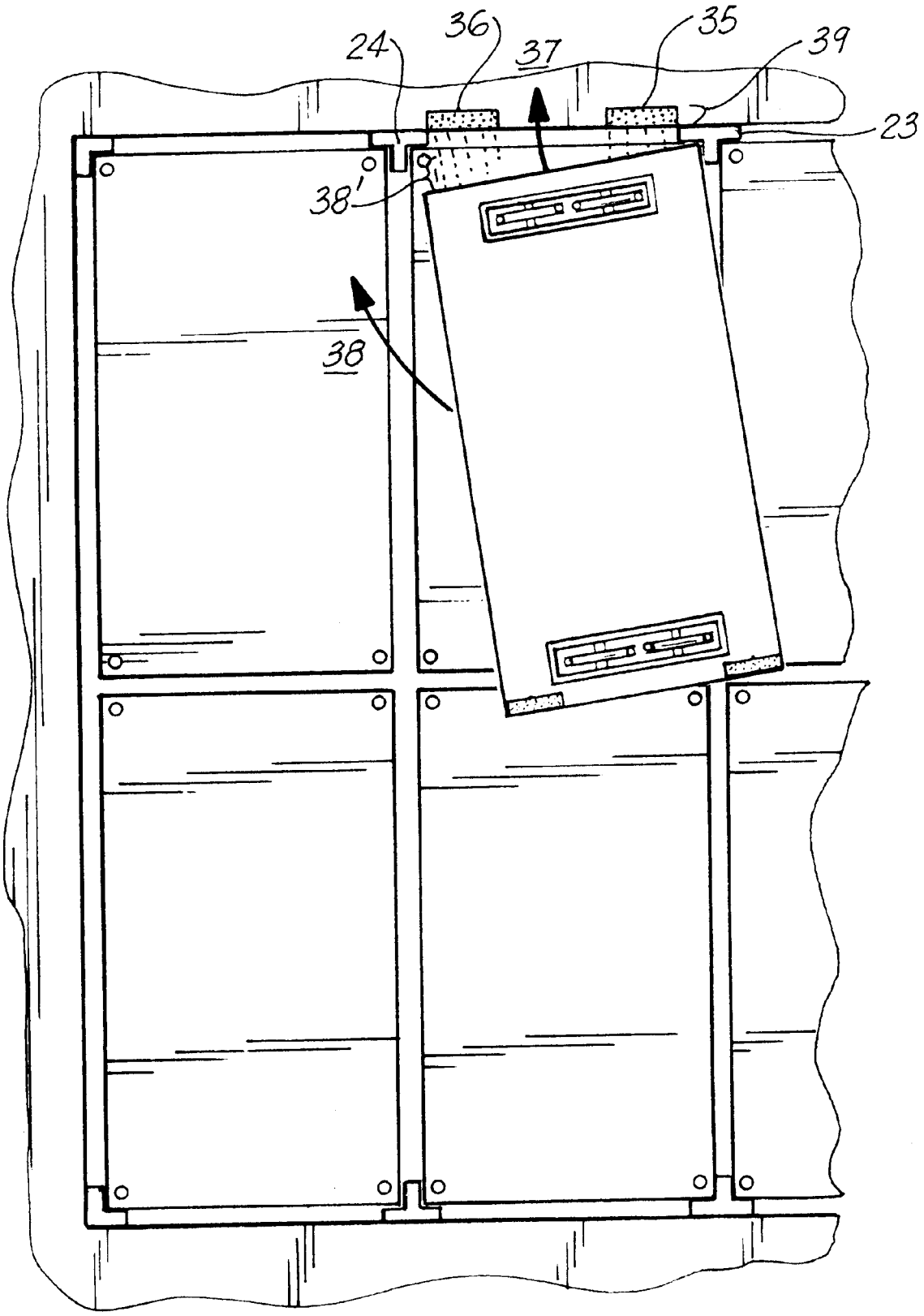
FIG. 3A is a top view of a first alternative embodiment of the system of FIG. 1, illustrating the placement of first and second electromagnets along a support wall, adjacent to the loading slots, so as to facilitate attraction of a suspended cargo container nearby, attracting same so as to draw it against said support wall, and the cargo containers edges between the adjacent loading slots.

FIG. 3A illustrates an alternative embodiment of the present invention, wherein first 35 and second 36 magnets are positioned in the vicinity of the first 23 and second 24 slots respectively, exterior of the trolley, spreader bar, and container to be loaded, such the operator may position the unaligned container such that a first corner of the container is positioned generally adjacent to the first slot 23. The operator may then energize one or both magnets 35, 36, providing magnetic fields 38', 39, thereby urging 37 the container toward the magnets, and aligning 38 the container to the appropriate attitude for continuing lowering the container to the lock down area. Upon proper alignment, the operator may then cease energizing the magnets, as desired.

Figure 3B:
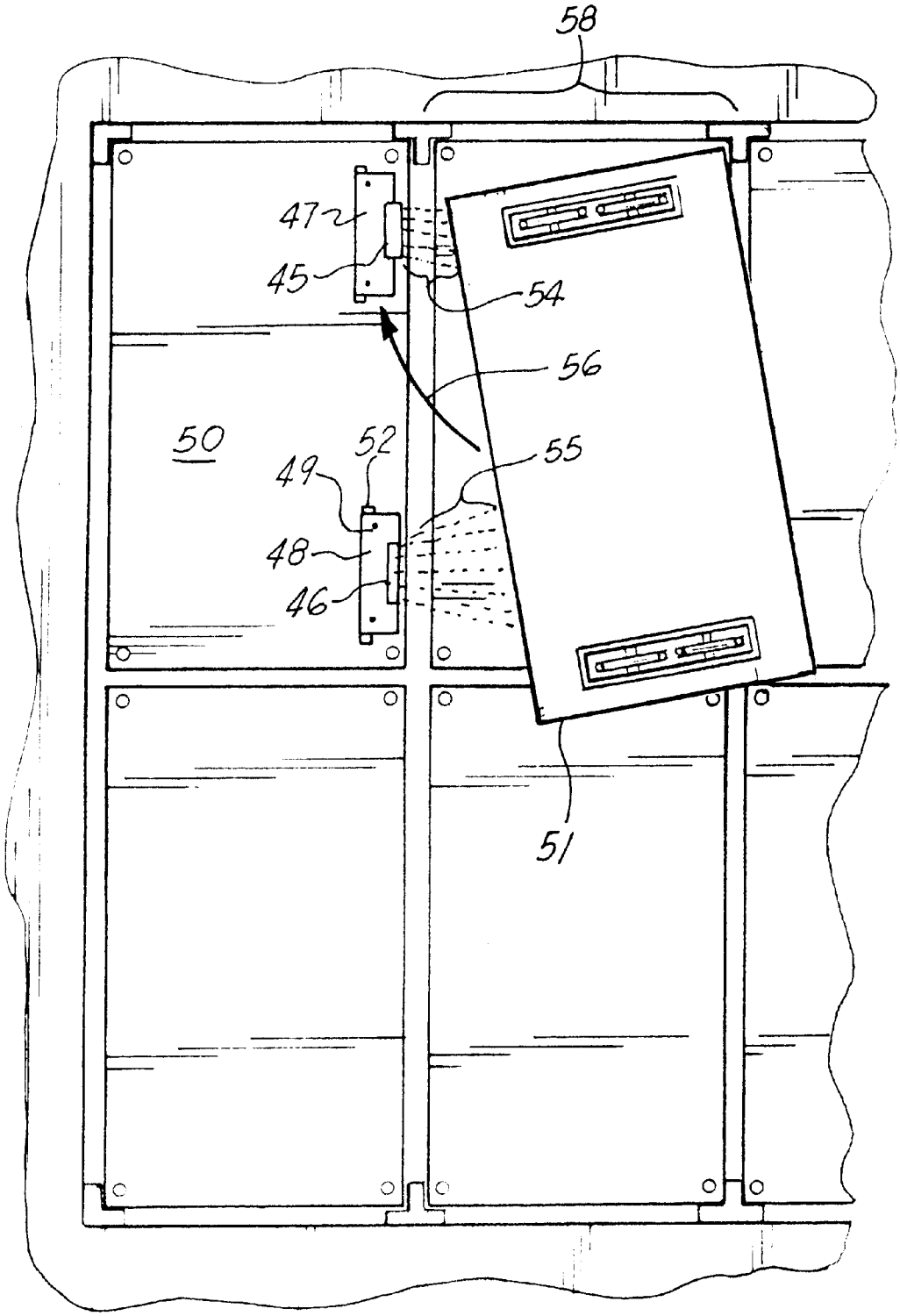
FIG. 3B is a top view of a second alternative embodiment of the system of FIG. 1, illustrating the placement of first and second electromagnets adjacent to the loading area of a container, so as to facilitate attraction of a suspended cargo container nearby, attracting same so as to draw it in the vicinity of the electromagnets, thereby positioning same in the desired lock-down area.

FIG. 3B illustrates a second alternative embodiment of the present invention, wherein first 45 and second 46 magnets mounted on first 47 and second 48 stands, respectively are mounted adjacent to a lock-down area for the suspended container 51, and are energized upon placement of suspended container 51 thereby, allowing the magnetic fields 54, 55 produced by the magnets, respectively, to urge 56 the suspended container into an aligned attitude above the lock-down area 58.

Another alternative embodiment might include the utilization of a sensor array to automatically monitor the position of the suspended container relative to the lock-down area, and selective powering of positioned magnets in the area to direct the container to the appropriate attitude.

Figure 5A:
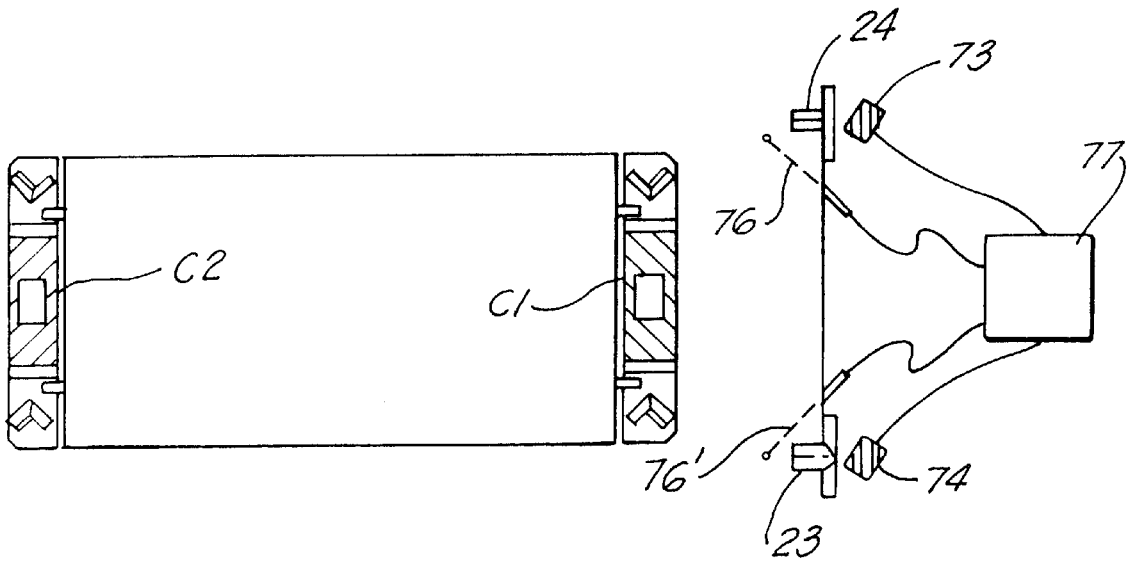
FIG. 5A illustrates still another alternative embodiment of the present invention, wherein there is provided sensors to automatically engage selected electromagnets when the container is in the vicinity of the loading slots.
Figure 5B:
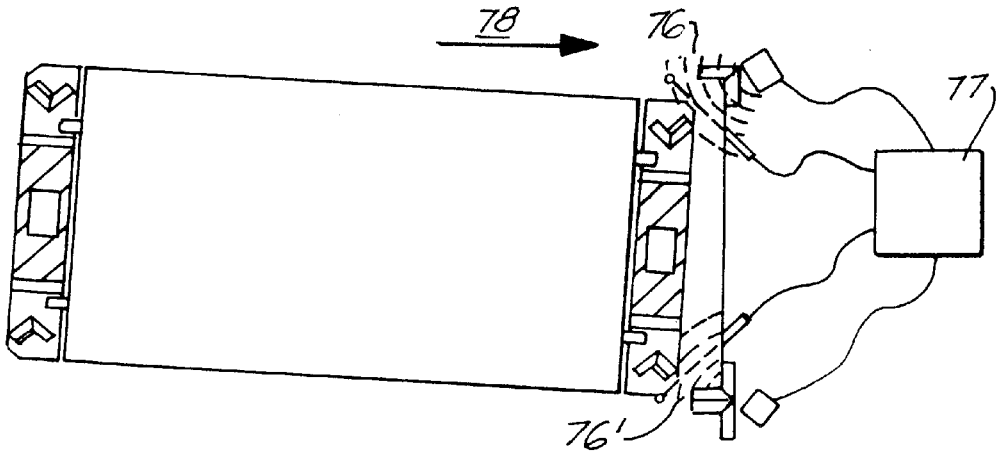
FIG. 5B illustrates the embodiment of FIG. 5A, wherein a sensor has initiated the first magnet, projecting a magnetic field which attracts the container thereto.

Referring to FIGS. 5A and 5B, as indicated, as the cargo container is lifted from the dock to the ship, its rotational attitude is uncontrolled. Consequently, when it reaches the point above the hold from which it will be lowered, it must be brought into a corrected attitude which will allow it to descend into the hold without colliding with the hold or its guide rails.

The container C is properly aligned when either of its ends is approximately centered between infrared light beams 76, 76' which intersect the slots 23, 24 forming the cargo holds corners. Therefore, if upon arrival above the hold, the container's attitude causes it to pass through infrared light beam 76, but not beam 76' it must be pulled in the direction of beam 76' to be brought into alignment.

Electromagnets 73, 74 are positioned on opposite sides of the hold so that if either electromagnet is energized independently of the other, it will draw the container towards itself The electromagnets are controlled by an electronic circuit 77 which may include photo resistors which receive infrared light beams 76, 76'. This circuit is designed so that both electromagnets remain deenergized as long as neither infrared light beam is broken. However, anytime beam 76 is broken independently of beam 76', electromagnet 74 is energized, and anytime beam 76' is broken independently, electromagnet 73 is energized.

Because electromagnet 74 is positioned on the corner of the cargo hold opposite beam 76', if the container's uncontrolled attitude upon arrival above the hold causes it to break beam 76' but not beam 76, electromagnet 73 will be energized, drawing the container in the proper direction away from 76' and towards beam 76 which has the effect of "squaring up" the containers position above the hold. If the container swings too far, clearing beam 76' while breaking beam 76, electromagnet 74 will then be energized, drawing the container back towards center.

These automatic back-and-forth corrections will swing the continuously narrowing arcs until the container's oscillations finally bring it into an attitude which both beams simultaneously. At this point the container is centered above the hold and is ready to be lowered.

At the moment the container breaks both infrared light beams simultaneously, informing the electronic circuit that the container is centered, electromagnets 73, 74 are immediately deenergized and electromagnet $C_1C_2$, located on either end of the cargo transporter, are then energized to hold the container in the proper attitude as it is lowered.

It is also recognized by the designer that all four electromagnets, C1, C2, 73, and 74, could be installed on the spreader bar, trolley, or cargo porter itself with no material deterioration of the system's operation. Preferred electromagnet positions will be determined based upon the application and other criteria.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A positioning system for positioning a container in the hold of a vessel said positioning system further comprising:

first and second, generally vertically situated loading slots for mounting upon said vessel;

a container support member having first and second sides, first and second ends, an upper side, and a lower side, said lower side of said container support member having engagement means for engaging said container, said upper side including support means for supporting said container support member and said container, said container support member further comprising first electromagnetic positioning means mounted to said container support member for selectively providing a magnetic field in the vicinity of said first and second loading slots;

second electromagnetic positioning means for providing a magnetic field emanating from at least one of said first or second loading slots, said first and second electromagnetic positioning means configured to urge said container in alignment with said first and second loading slots.

2. The positioning system of claim 1, wherein there is further provided sensing means for sensing the position of said container relative to said loading slots, said sensing means further selectively controlling said first electromagnetic positioning means to selectively engage a magnetic field in the vicinity of said loading slots, so as to control and selectively urge said container support member towards said loading slots.

3. The positioning system of claim 1, wherein said container support member has first, second, third, and fourth corners, and said first electromagnetic positioning means comprises first and second electromagnets mounted in the vicinity of said first and second corners, respectively.

4. The positioning system of claim 3, wherein there is further provided third and fourth electromagnets mounted in the vicinity of said third and fourth corners.

5. The positioning system of claim 4, wherein each of said first, second, third and fourth electromagnets may each be selectively energized.

6. The positioning system for claim 5, wherein said sensing means further selectively controls said electromagnetic positioning mean to selectively engage at least one of said first, second, third or fourth electromagnets which may be in the vicinity of said loading slots, so as to control and selectively urge said container support member towards said loading slots.

7. A method of positioning a container at a lock-down area near a structure, comprising the steps of:

a. providing a container support member having first and second sides, first and second ends, an upper side, and a lower side, said lower side of said container support member having engagement means for engaging said container, said upper side including support means for supporting said container support member and said container, said container support member further comprising electromagnetic positioning means situated adjacent to at least one of said first or second sides, or first or second ends, said electromagnetic positioning means for selectively providing a magnetic field in the vicinity of a nearby structure, so as to selectively urge said container support member towards said structure;

b. engaging said container support member to said container;

c. lifting said container support member and said container, and positioning said container in the vicinity of a lock-down area;

d. positioning said container by selectively energizing said electromagnetic positioning means, creating an electromagnetic field in the vicinity of a structure, urging the container closer to the structure;

e. aligning said container with said lock-down area;

f. lowering said container upon said lock-down area, g. engaging said container to said lock-down area.

8. The method of claim 7, wherein in step "a" there is further provided the step of providing sensing means for sensing the position of said container relative to said structure, and in step "d" there is further provided the step of utilizing said sensing means to selectively control said electromagnetic positioning means to selectively engage a magnetic field in the vicinity of a nearby structure, selectively urge said container support member towards said structure.

9. A positioning system for positioning a container in the hold of a vessel, comprising:

first and second, generally vertically for situating loading slots situated upon the vessel;

a container support member having first and second sides, first and second ends, an upper side, and a lower side, said lower side of said container support member having engagement means for engaging said container, said upper side including support means for supporting said container support member upon said container;

first electromagnetic positioning means situated in the vicinity of at least one of said first or second loading slots, said electromagnetic positioning means for selectively providing a magnetic field in the vicinity of said first or second loading slots, so as to selectively urge said container towards said first or second loading slots;

second electromagnetic positioning means situated in the vicinity of at least one of said container support member, said second electromagnetic positioning means for selectively providing a magnetic field in the vicinity of said container, so as to selectively urge in cooperation with said first electromagnetic positioning means, said container in alignment with said first or second loading slots.

10. The positioning system of claim 9, wherein there is further provided sensing means for sensing the position of said container relative to said first or second loading slots, said sensing means further selectively controlling said first electromagnetic positioning means to selectively engage a magnetic field in the vicinity of said first or second loading slots, so as to control and selectively urge said container support member towards said first or second loading slots.

11. A method of positioning a container at a lock-down area in the hold of a vessel, said vessel further including first and second, generally vertically situated loading slots, comprising the steps of:

a. providing a container support member having first and second sides, first and second ends, an upper side, and a lower side, said lower side of said container support member having engagement means for engaging said container, said upper side including support means for supporting said container support member and said container, said container support member further comprising electromagnetic positioning means situated adjacent to at least one of said first or second sides, or first or second ends, said electromagnetic positioning means for selectively providing a magnetic field in the vicinity of a nearby structure, in such a manner as to selectively urge said container support member towards said structure, so as to align said container with said first and second loading slots, said electromagnetic positioning means also selectively providing a magnetic field in the vicinity of a nearby structure, so as to selectively urge said container support member towards said structure;

b. engaging said container support member to said container;

c. lifting said container support member and said container, and positioning said container in the vicinity of said first and second loading slots;

d. positioning said container by selectively energizing said electromagnetic positioning means, creating an electromagnetic field in the vicinity of a structure, so as to urge one end of said container generally between said first and second loading slots;

e. aligning said container between said loading slots;

f. lowering said container between said loading slots and upon said lock-down area;

g. engaging said container to said lock-down area.

12. The positioning system of claim 11, wherein in step "a" there is further provided sensing means for sensing the position of said container relative to said first or second loading slots, and there is further provided in step "d" the additional step of said sensing means further selectively controlling said electromagnetic positioning means to selectively engage a magnetic field in the vicinity of a nearby structure, selectively urging said one end of said container support member between and aligned with said first and second loading slots.

13. The positioning system of claim 11, wherein in step "a" said container support member has first, second, third, and forth corners, and said electromagnetic positioning means comprises first and second electromagnets mounted in the vicinity of said first and second corners, and there is further provided sensing means for sensing the position of said container relative to said structure, and in step "d" there is provided the additional step of utilizing said sensing means to control said electromagnetic positioning means in order to selectively engage at least one of said first, second, third or fourth electromagnets which may be in the vicinity of said first or second loading slots, so as to control and selectively urge said container support member in alignment with and between said loading slots.

* * * * *